US005649892A

United States Patent [19]

Auerbach

[11] Patent Number: 5,649,892

[45] Date of Patent: *Jul. 22, 1997

[54] APPARATUS AND METHOD FOR CONVEYING A SHEET

[75] Inventor: David R. Auerbach, Redding, Conn.

[73] Assignee: Pitney Bowes Inc., Stamford, Conn.

[ * ] Notice: The portion of the term of this patent subsequent to Mar. 17, 2015, has been disclaimed.

[21] Appl. No.: 406,286

[22] Filed: Mar. 17, 1995

[51] Int. Cl.[6] ..... B31F 1/00

[52] U.S. Cl. ..... 493/420; 493/27; 493/29; 198/369.2

[58] Field of Search ..... 271/9, 13, 273, 271/198, 199, 258.03, 265.01; 270/45, 51; 198/369.2, 592, 861.5; 493/8–12, 21–27, 28, 29, 416–421, 436

[56] References Cited

U.S. PATENT DOCUMENTS

| | | | |
|---|---|---|---|
| 2,190,414 | 2/1940 | Davidson et al. | 270/62 |
| 2,230,168 | 1/1941 | Spiess | 270/68 |
| 2,253,446 | 8/1941 | Spiess | 493/420 |
| 3,580,141 | 5/1971 | Richter | 493/27 |
| 3,961,781 | 6/1976 | Funk | 270/20 |
| 4,085,928 | 4/1978 | Sussman | 493/14 |
| 4,533,135 | 8/1985 | Barker | 271/273 |
| 4,570,923 | 2/1986 | Hooper et al. | 271/275 |
| 4,616,815 | 10/1986 | Vijuk | 270/45 |
| 4,618,302 | 10/1986 | Kokubo | 271/273 |
| 4,756,399 | 7/1988 | Scata | 198/369.2 |
| 4,878,087 | 10/1989 | Sakai | 271/258.03 |
| 5,078,255 | 1/1992 | Haley | 198/369.2 |
| 5,121,916 | 6/1992 | Sanchez | 271/198 |
| 5,137,506 | 8/1992 | Haenel | 493/417 |
| 5,183,246 | 2/1993 | Edwards | 270/45 |
| 5,275,395 | 1/1994 | Boggiano | 271/259 |
| 5,342,038 | 8/1994 | Suter | 271/198 |
| 5,358,234 | 10/1994 | Boriani | 271/198 |
| 5,358,464 | 10/1994 | Funk | 493/320 |
| 5,374,233 | 12/1994 | Lehmann | 493/421 |
| 5,433,431 | 7/1995 | Lowell | 271/273 |
| 5,441,253 | 8/1995 | Takemoto | 271/273 |

FOREIGN PATENT DOCUMENTS

| | | | |
|---|---|---|---|
| 2262583 | 7/1973 | Germany | 271/258.03 |
| 236716 | 6/1986 | Germany | 271/258.03 |

*Primary Examiner*—Joseph J. Hail, III
*Assistant Examiner*—Christopher W. Day
*Attorney, Agent, or Firm*—Angelo N. Chaclas; Charles R. Malandra, Jr.; Melvin J. Scolnick

[57] ABSTRACT

A conveyor apparatus for use in a sheet handling apparatus including an upstream module having an output end and a downstream module having an input end where the upstream module output end is capable of discharging the sheet from a plurality of output positions. The conveyor apparatus feeds the sheet in a path of travel from the upstream module output end to the downstream module input end. The conveyor module comprising: a frame, a carriage having an input end adjacent the upstream module output end and an output end adjacent the downstream module input end, the carriage output end pivotally mounted to the frame so that the carriage input end is selectively rotatable to receive the sheet from a predetermined output position of the upstream module, and the carriage including conveyor means for feeding the sheet from the upstream module output end to the downstream module input end.

9 Claims, 9 Drawing Sheets

APPARATUS AND METHOD FOR CONVEYING A SHEET

RELATED APPLICATIONS

This application is related to copending U.S. patent application Ser. No. 08/406,288, entitled INSERTER INCLUDING A PIVOTING CONVEYOR WITH STAGING CAPABILITY, filed concurrently herewith and assigned to the assignee of this application.

FIELD OF THE INVENTION

This invention relates to sheet processing machines having a sheet folder module. More particularly, this invention is directed to a method and apparatus for conveying a sheet away from the folder module.

BACKGROUND OF THE INVENTION

Machines for processing sheets of paper, such as inserters, are well known in the art. A typical inserter may include: a cut sheet feeder module, a web sheet burster module, an accumulator module, a right angle transport module, a folder module, an insert module and a moistener/sealer module. This list is not intended to be exhaustive, but merely illustrative, of the wide range of functionality that is often incorporated into an inserter. Generally, inserter manufacturers custom build each machine to meet the needs of a particular user or customer. As a result, an inserter may be comprised of different arrangements and combinations of modules according to the customer's needs.

Typically, inserters of the kind described above are used in printing, book binding and direct mailing operations. An example of such an inserter is Model 8300 available from Pitney Bowes Inc., Stamford, Conn.

To simplify the manufacturing process the manufactures develop each module as a self contained independent unit or workstation. This provides flexibility during the manufacturing process of an inserter because each module is adapted to easily connect with other modules. For example, one common technique is designing the input end and the output end of every module to be at a fixed horizontal elevation which is uniform for all of the different modules. Thus, the different modules may be easily coupled together because the output end of a first module will be in horizontal alignment with the input end of a second module. However, a notable exception to this arrangement is the folder module.

The folder module contains a series of pairs of folding rollers, buckle chutes, and end stops for folding a single sheet or a collection of sheets. Typically, each pair of folding rollers is offset both horizontally and vertically from the previous pair of folding rollers. Each buckle chute and corresponding pair of feed rollers is responsible for making a single fold in the sheet. The location of the fold along the sheet depends on how far the sheet is feed into the buckle chute and is thus controlled by the position of an adjustable end stop within the buckle chute. Accordingly, the buckle chutes can be arranged to create more than one fold in a sheet.

At each installation different final configurations for the sheet are required. These configurations vary depending on the needs of the user at the time. Examples of a few configurations that users desire to make are: half fold—a single fold that divides the sheet into two equal portions, C fold—a combination of two folds that divide the sheet into three substantially equal portions with the folded ends angled inward toward each other and Z fold—a combination of two folds that divide the sheet into three substantially equal portions with the folded ends angled away from each other. Additionally, other configurations may be desired which require three or four folds. Thus, the folder module must be capable of producing a wide variety of folds and also be flexible so as to adapt to new folding requirements. To accomplish this, the folder module includes adjustments which control the number of buckle chutes that the sheet encounters and also the distance that the sheet travels into each buckle chute. As a result, any desired configuration may be obtained.

After the sheet or sheets have been folded into the desired configuration, it is desirable to then feed them downstream to another module in the inserter for further processing. Therefore, the need exists to operatively connect the output end of the folder module with the input end of the downstream module so that the sheet is automatically fed downstream. Generally, the input end of the downstream module is located at only one fixed horizontal elevation. In contrast, the output end of the folder module will be at one of several different horizontal elevations depending upon the desired fold configuration. Thus, the sheet will necessarily be output by different pairs of folding rollers. This fact greatly complicates operatively connecting the output end of the folder module to the input end of the downstream module because their respective horizontal elevations are different.

Prior art systems seek to solve this problem by a variety of techniques. One approach is to determine which pair of folding rollers the sheet will exit from to achieve a desired fold configuration and then raising or lowering the folder module accordingly until the output from a selected pair of rollers is in horizontal alignment with the input end of the downstream module. To achieve this, the folder module is placed on an elevator or platform so that it can be raised or lowered. Although this approach solves one problem it creates another. By raising or lowering the folder module the output end of the folder module is now in horizontal alignment with the downstream module, however, the input end of the folder module is no longer in horizontal alignment with the output end of a first upstream module. To solve this newly created problem the first module upstream from the folder module is also placed on the elevator and raised or lowered along with the folder module. Similarly, it can be appreciated that this problem is now repeated between the first upstream module and every other module upstream from it. Thus, for the problems to ultimately be solved every module upstream from the folder module must also be adjusted vertically along with the folder module. In addition to being costly, this arrangement is also time consuming.

Another prior art system, disclosed in U.S. Pat. No. 2,230,168, entitled BUCKLING FOLDING MACHINE, takes a different approach. It teaches a device on the output end of the folder module which is mounted to the last buckle chute to be used. However, if the last buckle chute to be used changes, then the device must be uninstalled completely and next reinstalled at the new location. As in the other prior art system, this arrangement is time consuming to reconfigure.

Accordingly, there is a need for an adaptable and flexible system that allows the output of a folder module to be connected to the input end of the downstream module easily, quickly and cost effectively without disturbing the upstream modules.

SUMMARY OF THE INVENTION

Accordingly, it is an object of the present invention to provide an apparatus and method which provides a practical solution to the problems discussed above.

It is another object of the present invention to provide an apparatus and method which reduces set-up time.

In accomplishing these and other objects there is provided a method and apparatus for conveying a sheet. The present invention teaches a conveyor module for use in a sheet handling apparatus including an upstream module having an output end and a downstream module having an input end where the upstream module output end is capable of discharging the sheet from a plurality of output positions. The conveyor module feeds the sheet in a path of travel from the upstream module output end to the downstream module input end. The conveyor module comprising: a frame, a carriage having an input end adjacent the upstream module output end and an output end adjacent the downstream module input end, the carriage output end pivotally mounted to the frame so that the carriage input end is selectively rotatable to receive the sheet from a predetermined output position of the upstream module, and the carriage including conveyor means for feeding the sheet from the upstream module output end to the downstream module input end.

Therefore, it is now apparent that the invention achieves all the above objects and advantages. Additional objects and advantages of the invention will be set forth in the description which follows, and in part will be obvious from the description and/or drawings, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention. As shown throughout the drawings, like reference numerals designate like or corresponding parts.

DETAILED DESCRIPTION OF THE PREFERRED EMBODIMENT

Figure 1:
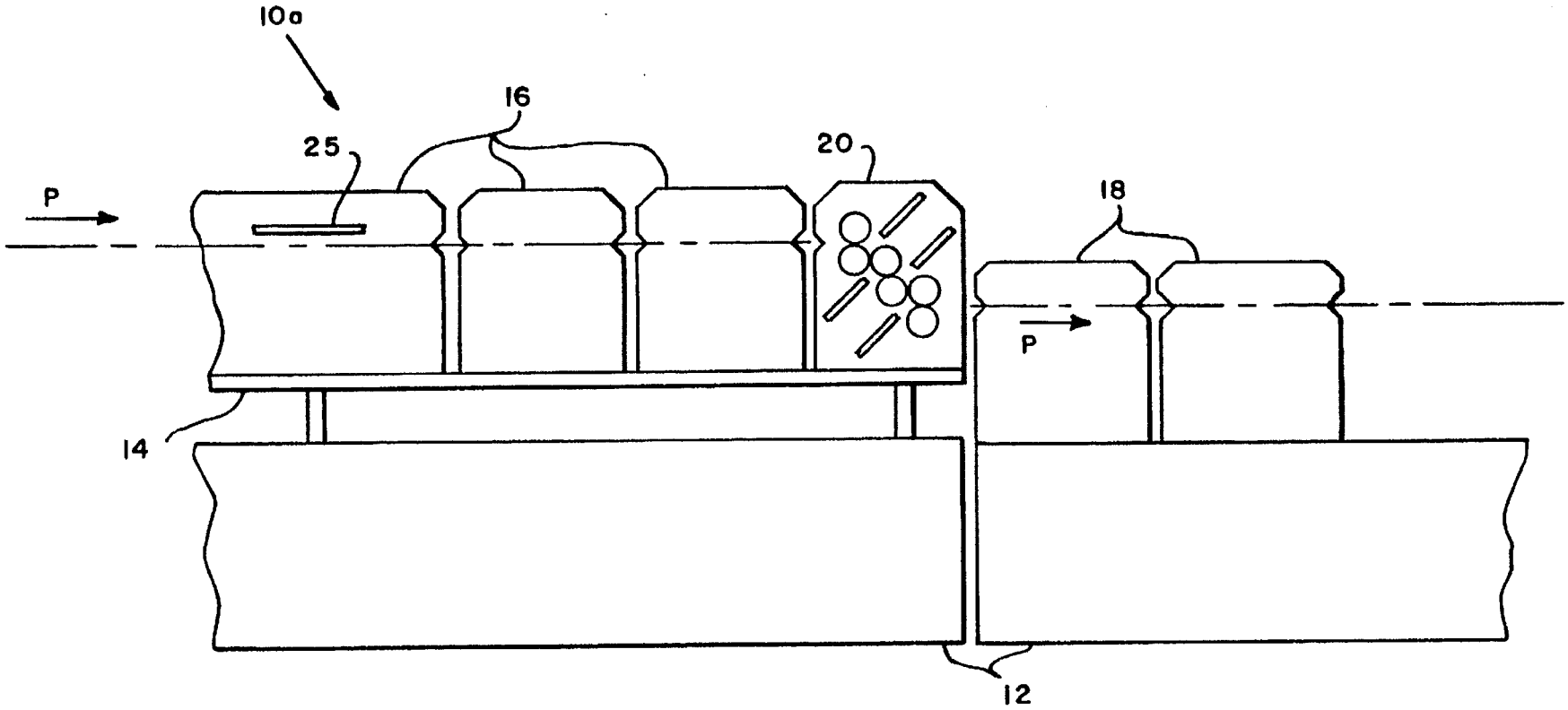
FIG. 1 (PRIOR ART)
FIG. 1 is a front view of a prior art console inserter having a folder module.
Figure 2:
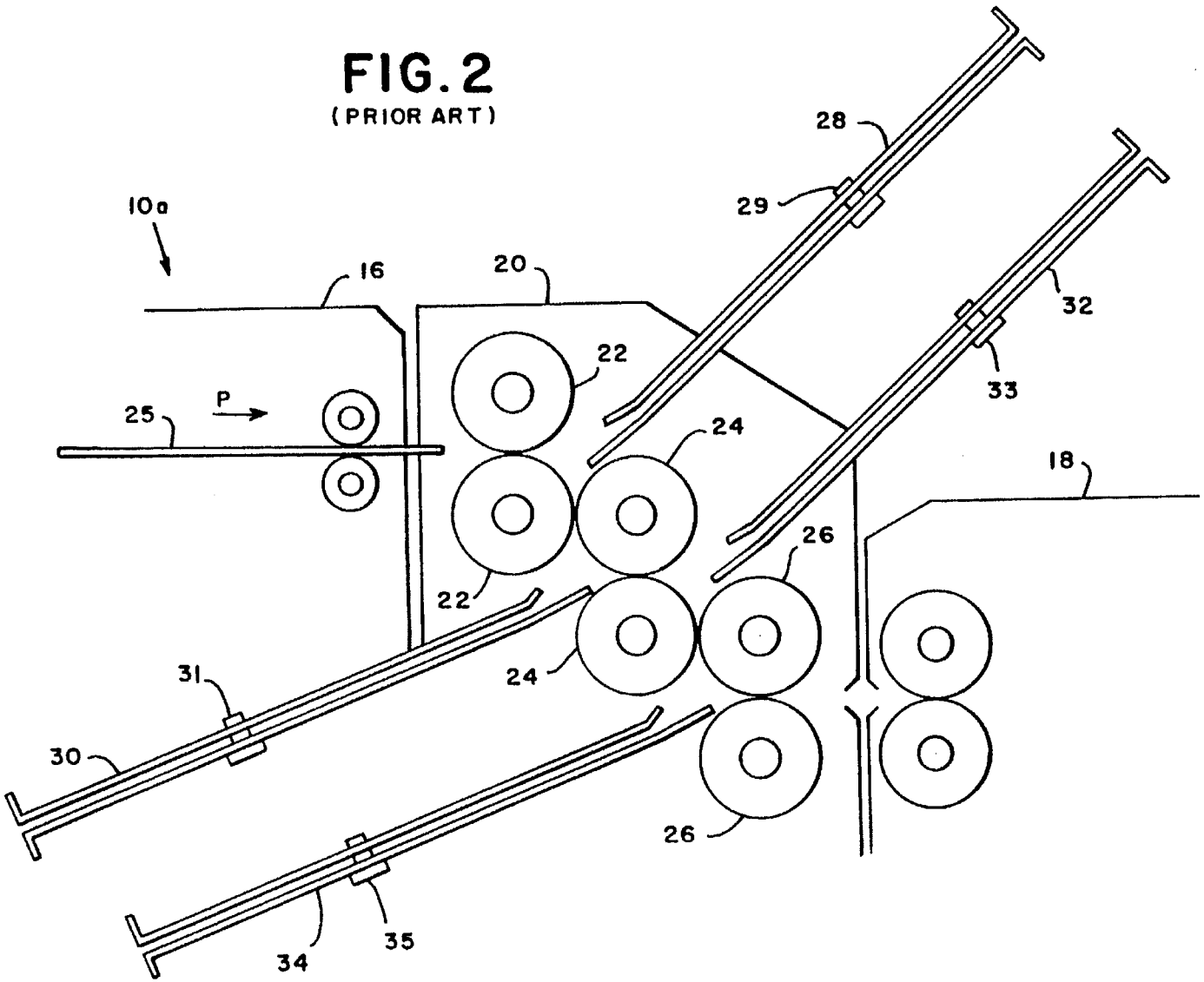
FIG. 2 (PRIOR ART)
FIG. 2 is a front view of a prior art folder module.

In FIGS. 1 and 2 a prior art general purpose inserter 10*a* is shown. Referring to FIG. 1, the general purpose inserter 10*a* includes a folder module 20, a console 12, an elevator platform 14, modules 16 and modules 18. A sheet 25 is feed through the inserter 10 in a downstream path of travel as indicated by arrows "P". As used herein, the term sheet refers generically to: cut paper sheets, tapes, checks, money, inserts and any other such suitable articles. Additionally, the term sheet is meant to include both a single sheet and an accumulation of more than one sheet. The modules 16 and 18 are represented as generic workstations each for performing a selected operation on the sheet 25, such as: web bursting, cut sheet feeding, accumulating, turning, inserting, etc. Those skilled in the art will appreciate that the individual operations performed by modules 16 and 18 are selected and arranged in a particular sequence according to the needs of the user or customer. Modules 16 are located upstream from the folder module 20 while modules 18 are located downstream. In order to understand and practice the present invention it is unnecessary to assign specific functions to the modules 16 and 18.

Referring to FIG. 2, the folder module 20, adjacent upstream module 16 and downstream module 18 are shown in more detail. The folder module 20 accepts the incoming sheet 25 and folds it into a desired configuration according to the user's requirements. The folder module 20 includes: a first pair of folding rollers 22, a second pair of folding rollers 24, a third pair of folding rollers 26, a first buckle chute 28, a second buckle chute 30, a third buckle chute 32 and a fourth buckle chute 34. Each buckle chute 28, 30, 32 and 34 contains a corresponding end stop 29, 31, 33 and 35, respectively. Alternatively, any one or several of the buckle chutes 28, 30, 32 and 34 may be replaced or bypassed by a diverter (not shown). The diverter serves to direct the incoming sheet away from the buckle chute so that it does not enter the buckle chute. Thus, the number and sequencing of the buckle chutes 28, 30, 32 and 34 that are actually used can be controlled. The position of the end stops 29, 31, 33 and 35 along the buckle chutes 28, 30, 32 and 34, respectively, also determines the type of fold that is achieved. Therefore, by controlling the number and sequencing of the buckle chutes 28, 30, 32 and 34 that the sheet 25 encounters and by adjusting the position of the end stops 29, 31, 33 and 35, a desired fold configuration can be achieved. A more detailed description of a folder module is available in U.S. Pat. No. 5,183,246 issued on Feb. 2, 1993 entitled DIVERTING APPARATUS AND METHOD FOR IN-LINE INSERTING EQUIPMENT and in U.S. patent application Ser. No. 08/299,396, filed on Sep. 1, 1994 entitled BUCKLE CHUTE FOLDING MACHINE FOR DIFFERENT LENGTH SHEETS, both of which are assigned to the assignee of the present invention.

Referring to FIGS. 3, 4, 5 and 6 a conveyor module 100 is shown in accordance with the present invention. The conveyor module 100 is located downstream from and adjacent to folder module 20. A module 40 is located downstream from and adjacent to conveyor module 100. The conveyor module 100 accepts the sheet 25 from the output end of folder module 20 and feeds it in a path of travel to the input end of downstream module 40. The conveyor module 100 includes a frame 102 and other suitable structure (not shown) for supporting and mounting various components and parts in the conveyor module 100. The frame 102 includes first positioning hole 112, second positioning hole 114 and third positioning hole 116. The positioning holes 112, 114 and 116 correspond to the first, second and third pair of folding rollers 22, 24 and 26, respectively. Rotatively mounted to the frame 102 is a drive shaft 104. The drive shaft 104 extends transverse to the path of travel and is located adjacent to the input end of the downstream module 40. The positioning holes 112, 114 and 116 are arranged in a radial pattern about the drive shaft 104. Thus, the distance between the drive shaft 104 and each of the positioning holes 112, 114 and 116 is a known constant.

A carriage assembly 120 having a lower portion 121 and an upper portion 201 extends between the output end of the folder module 20 and the input end of the downstream module 40. The lower portion 121 and the upper portion 201 define a friction drive system for conveying the sheet 25 along the path of travel. The lower portion 121 includes a horizontal deck 122 and laterally opposed side walls 140 extending vertically from the deck 122 and parallel to the path of travel on either side of the sheet 25. Together, the deck 122 and side walls 140 form a generally U-shaped structure. A plurality of drive rollers 132 and 132*a* are disposed between the output end of the folder module 20 and the input end of the downstream module 40. Fixably mounted to the underside of deck 122 and extending vertically downward are drive roller brackets 130. The drive roller brackets 130 are substantially parallel to the path of travel. Drive roller shafts 136 are rotatively mounted to drive roller brackets 130 and are aligned transverse to the path of travel. Rotatively mounted to the drive roller shafts 136 are drive rollers 132. Drive rollers 132*a* is fixably mounted to the drive shaft 104. It should be noted that the deck 122 contains suitable openings 124 to allow a portion of the drive rollers 132 and 132*a* to extend above the deck 122 in the path of travel of sheet 25. An endless belt 138 engages the plurality of drive rollers 132 and 132*a*. It is important that the endless belt 138 be of a suitable material to provide adequate friction so that there is no slip between drive rollers 132 and 132*a* and the endless belt 138. Thus, as the drive shaft 104 rotates causing drive rollers 132*a* to rotate, the endless belt 138 will rotate in synchronous fashion with drive rollers 132*a* and thereby cause drive rollers 132 to also rotate.

The lower portion 121 is pivotably mounted to the drive shaft 104 using sleeves 126. Sleeves 126 are primarily hollow cylinders each having an inner hole 128 so that the sleeves 126 slip over the drive shaft 104. The diameter of inner holes 128 is selected relative to the diameter of the drive shaft 104 so that the drive shaft 104 rotates inside the inner holes 128. The side walls 140 have mounting flanges 146 which are adapted to fixably mount the side walls 140 to the sleeves 126. Those skilled in the art will now recognize that the lower portion 121 pivots about the drive shaft 104 independent of the rotation of the drive shaft 104.

Figure 3:
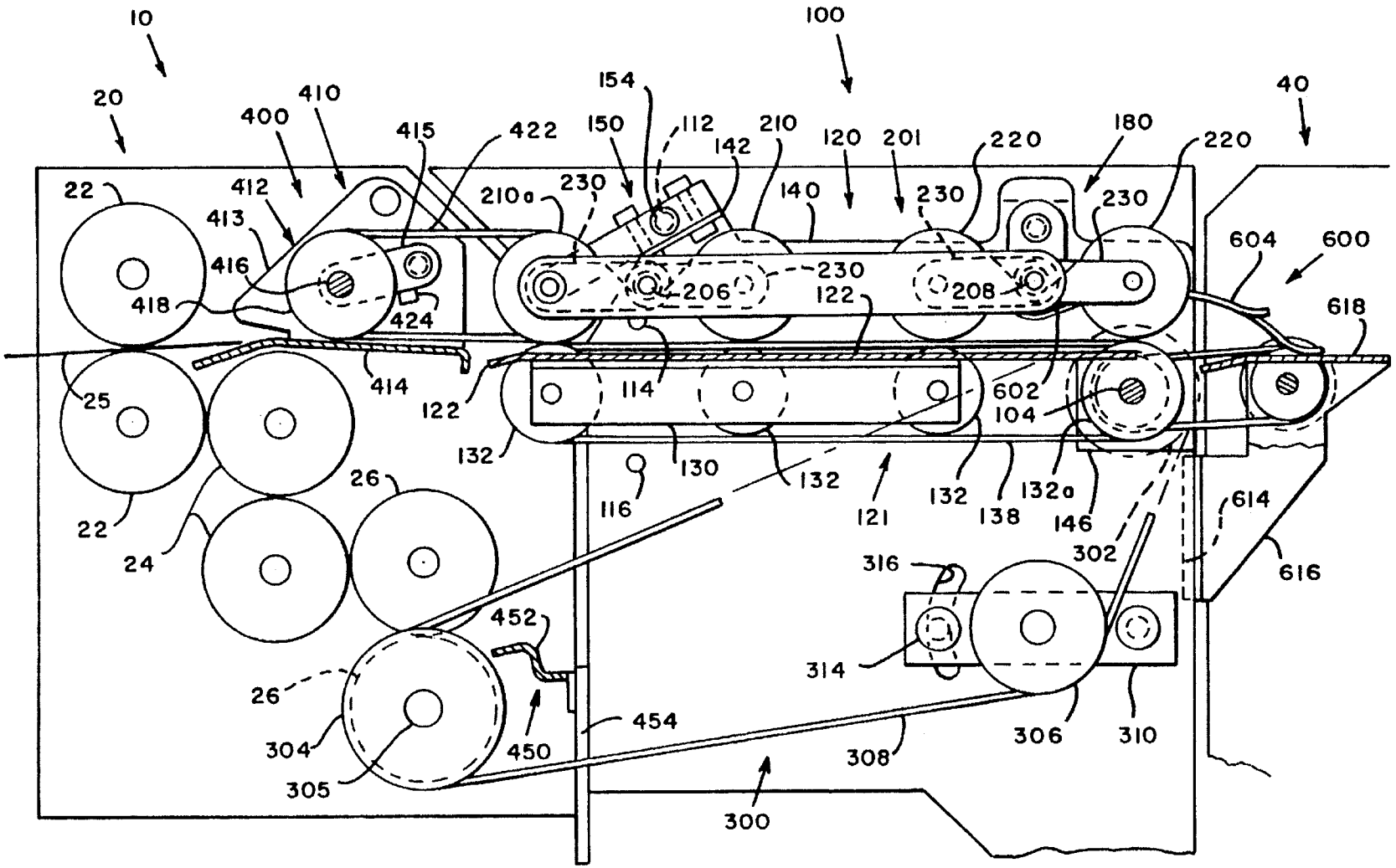
FIG. 3 is a front view of the folder module and a conveyor module in position A having the upper portion of a carriage assembly in a closed position in accordance with the present invention.
Figure 4:
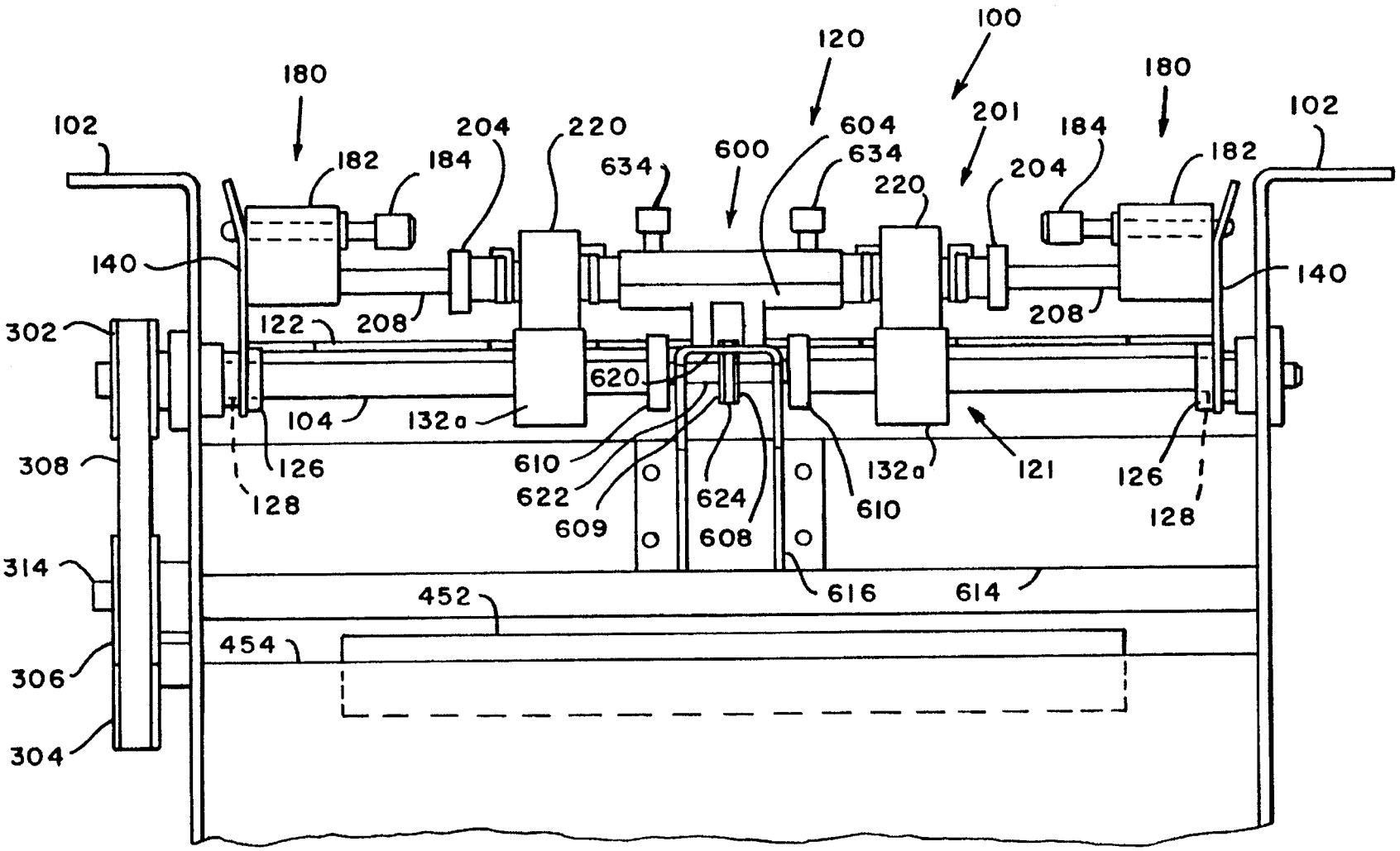
FIG. 4 is a right side view of the conveyor module in accordance with the present invention.
Figure 5:
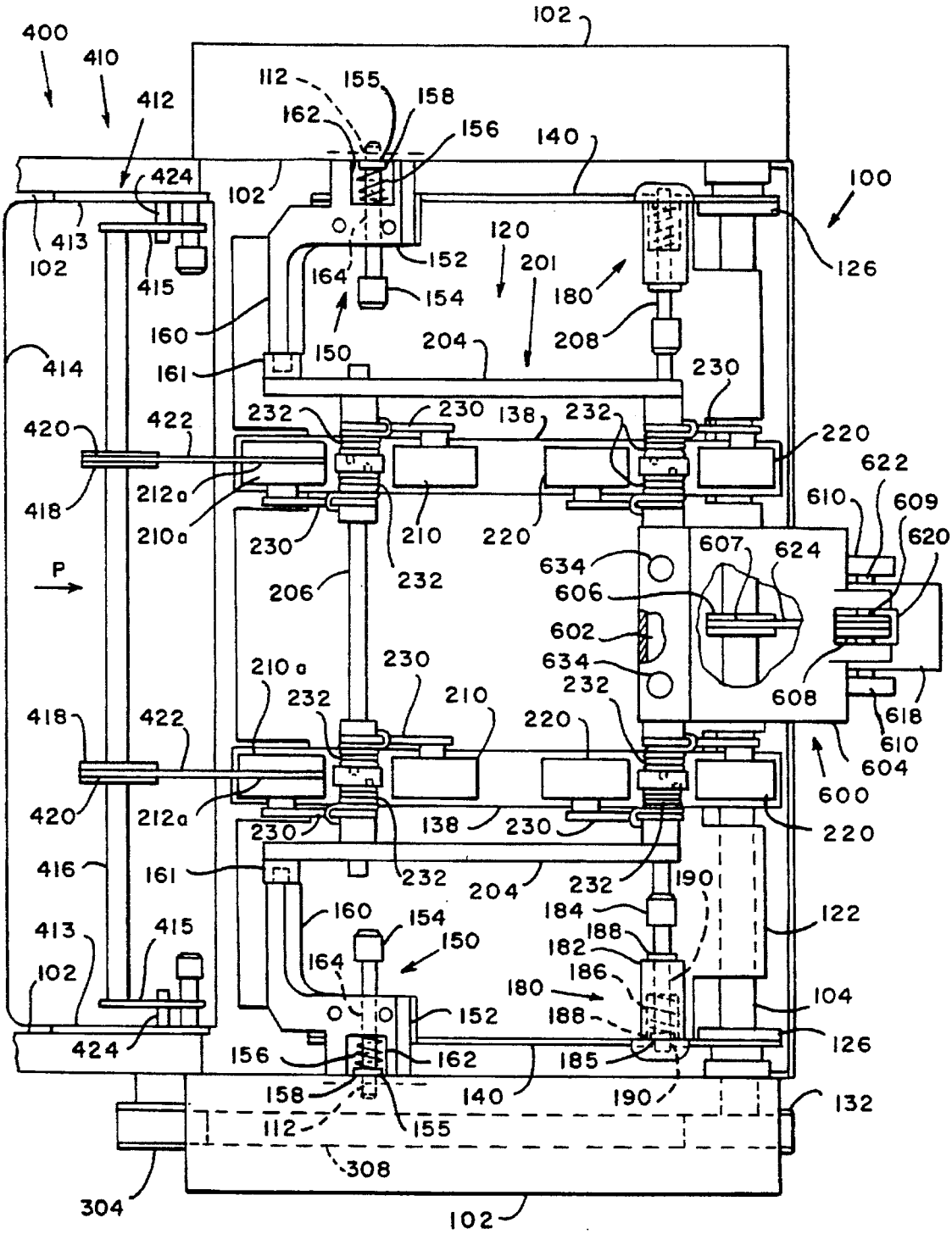
FIG. 5 is a plan view of the conveyor module in accordance with the present invention.
Figure 6:
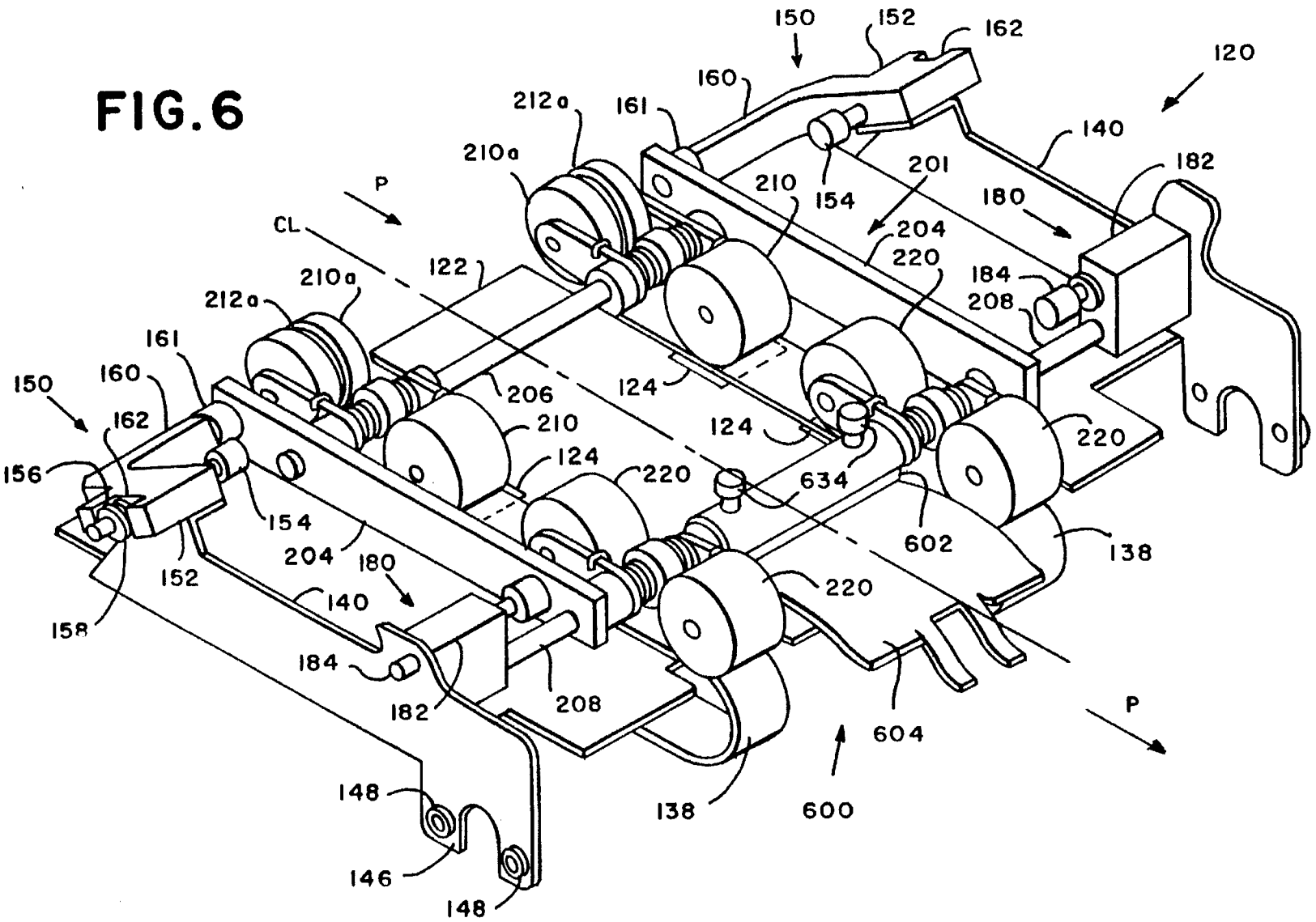
FIG. 6 is a front-right-plan perspective view of the conveyor module in accordance with the present invention.
Figure 7A:
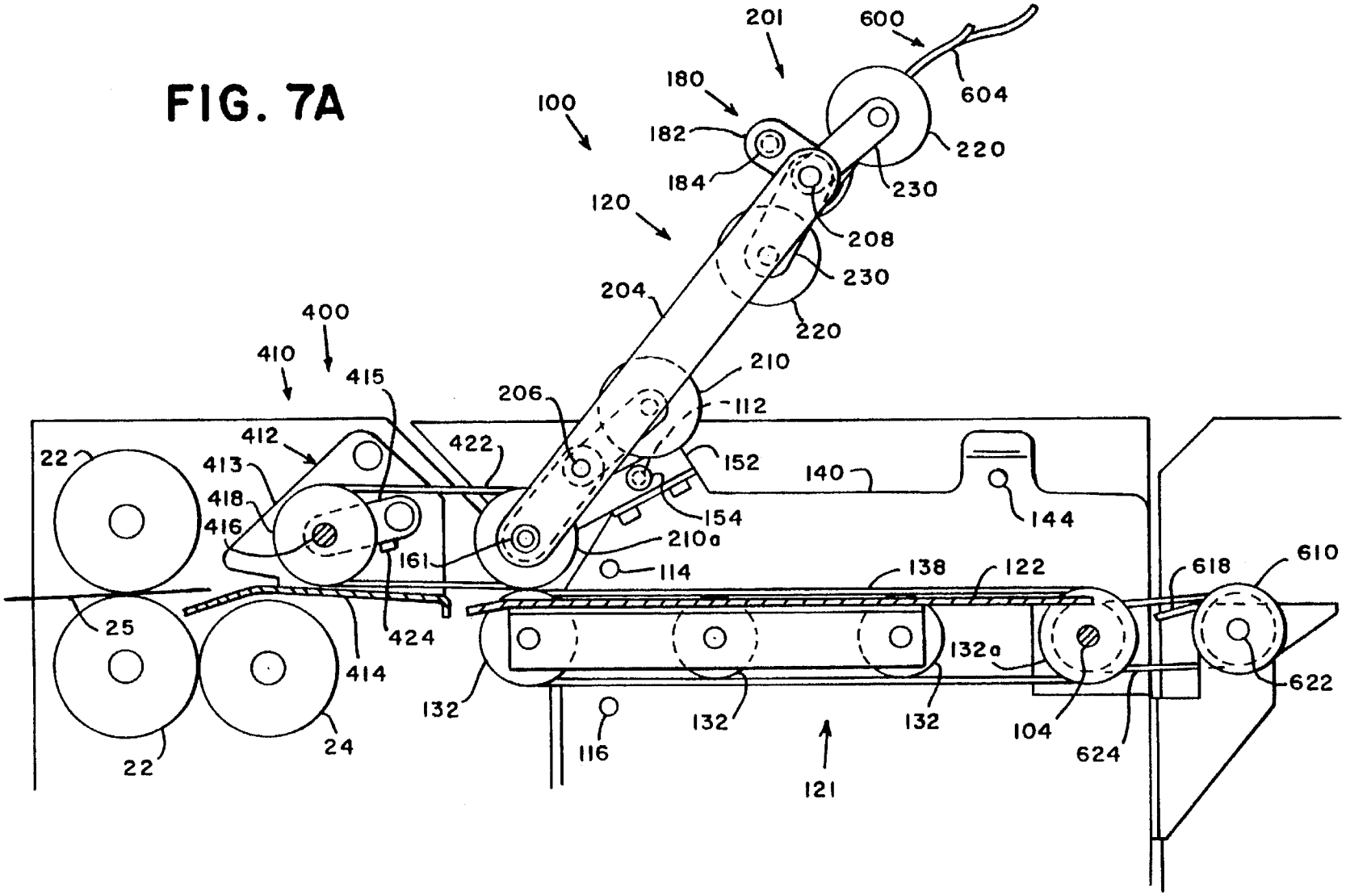
FIG. 7A is a front view of the conveyor module in position A having an upper portion of the carriage assembly in an open position in accordance with the present invention.
Figure 7B:
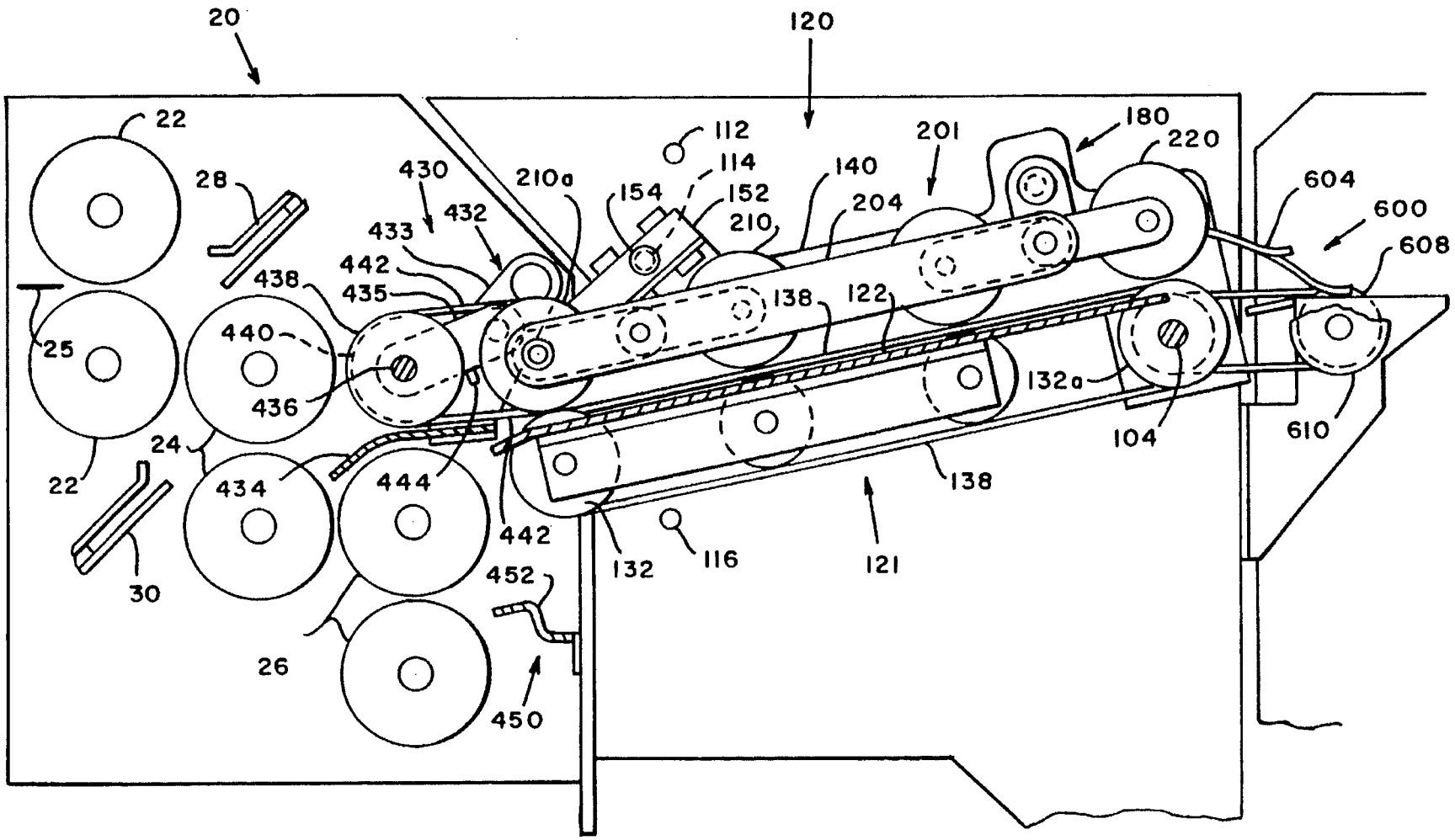
FIG. 7B is a front view of the conveyor module in position B having the upper portion of the carriage assembly in the closed position in accordance with the present invention.
Figure 7C:
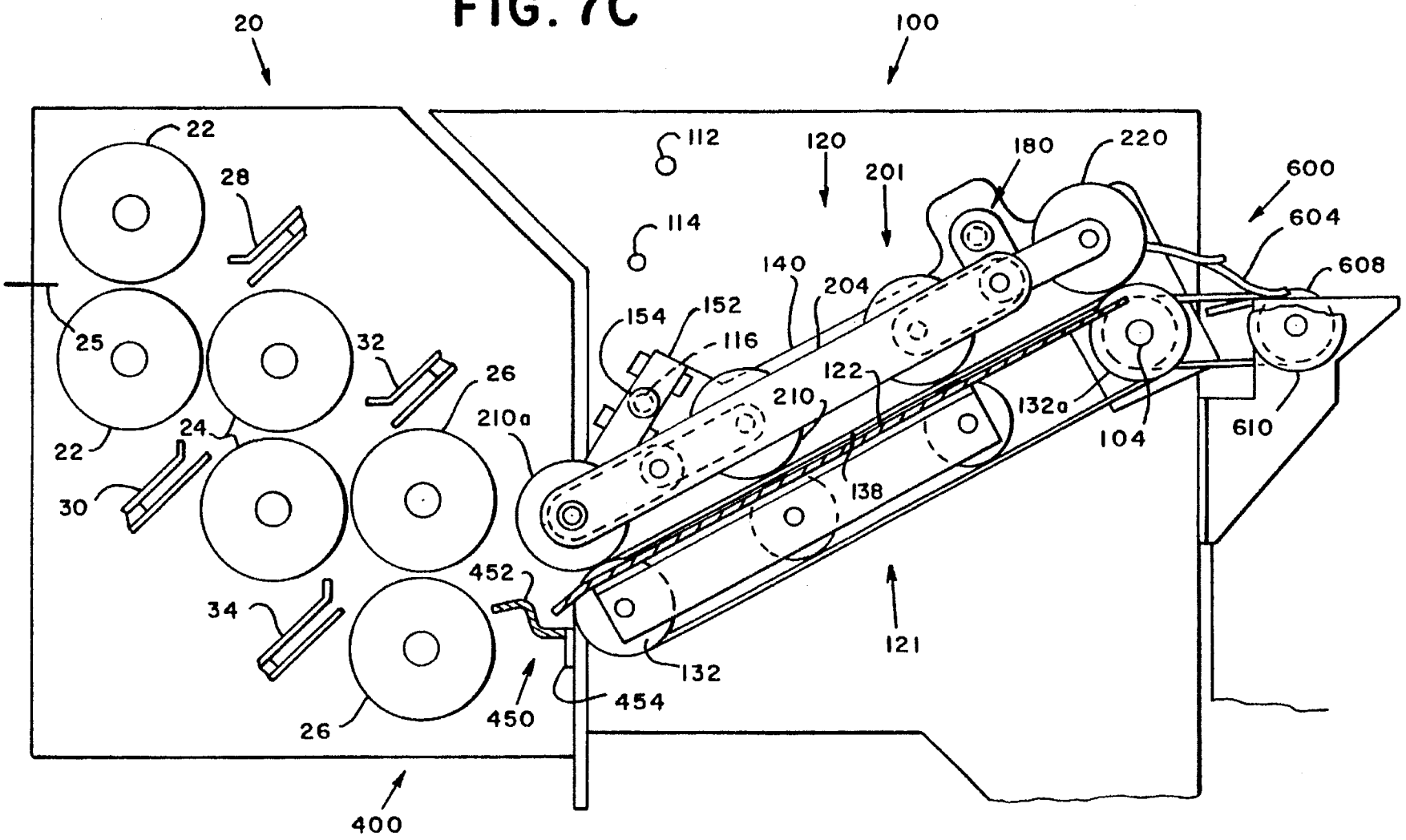
FIG. 7C is a front view of the conveyor module in position C having the upper portion of the carriage assembly in the closed position in accordance with the present invention.

A reposition latch assembly 150 is mounted to each of the side walls 140 for locking the carriage assembly 120 into one of three operative positions: position A as shown in FIGS. 3 and 7A, position B as shown in FIG. 7B and position C as shown in FIG. 7C. The following description is given only with respect to one of the side walls 140 since the reposition latch assembly 150 on the other side is analogous. The reposition latch assembly 150 includes: a reposition latch bracket 152, a reposition latch pin 154, a reposition latch spring 156, E-clips 158 and arm 160. The bracket 152 includes a recess 162 and a through hole 164 while the pin 154 includes grooves 155. The pin 154 is inserted through the hole 164 and through the spring 156 while the E-clips 158 are attached to grooves 155. Thus, the E-clips 158 are on each side of hole 164 with the spring 156 captured between the recess 162 and one of the E-clips 158. This creates a spring bias on the pin 154. It should now be appreciated that the spring loaded pin 154 slides along hole 164 but cannot be removed from the bracket 152 due to the E-clips 158 on either side of the hole 164. The pin 154 is biased so as to insert into positioning holes 112, 114 and 116 to define the three operative positions A, B and C, respectively.

The upper portion 201 of carriage assembly 120 includes: elongate members 204, a first upper shaft 206 and a second upper shaft 208. One end of elongate members 204 is pivotally mounted to arms 160 at pivot point 161 by any suitable conventional means. The first upper shaft 206 is fixably mounted to extend between the elongate members 204. The second upper shaft 208 is located downstream from the first upper shaft 206 and is also fixably mounted to extend between the elongate members 204. Thus, members 204 and shafts 206 and 208 form a chassis or framework for mounting other components. Additionally, the second upper shaft 208 extends beyond the elongate members 204 and is fixably attached to jam access latch assembly 180.

The upper portion 201 also includes a plurality of idler rollers 210, 210*a* and 220. The idler rollers 210 and 210*a* are mounted to first upper shaft 206 while the idler rollers 220 are mounted to the second upper shaft 208. Each of the idler rollers 210, 210*a* and 220 are attached to their respective shafts 206 and 208 by a similar sub-assembly. The idler rollers 210, 210*a* and 220 are rotatively attached to one end of brackets 230 while the other end of brackets 230 is pivotably mounted to shafts 206 and 208, respectively. Torsion springs 232 are attached to brackets 230 and shafts 206 and 208, respectively, by any suitable conventional means to provide a spring bias.

The jam access latch assembly 180 is mounted on both sides of the upper portion 201 for locking the upper portion 201 in a closed position where the upper portion 201 and the lower portion 121 are in working relationship. The following description is given only with respect to one side of the upper portion 201 since the jam access latch assembly 180 on the other side is analogous. In the closed position, the idler rollers 210, 210*a* and 220 are disposed generally parallel to the drive rollers 132 and 132*a*. The jam access latch assembly 180 is very similar to the reposition latch assembly 150. The jam access latch assembly 180 includes: a bracket 182 with a through hole 190, a pin 184 with grooves 185, a spring 186 and E-clips 188. The pin 184 is inserted through the hole 190 and spring 186 while the E-clips 188 are attached to grooves 185. Thus, the E-clips 188 are on each side of hole 190 with the spring 186 captured between the bracket 182 and one of the E-clips 188. This creates a spring bias on the pin 184. It should now be appreciated that the spring loaded pin 184 slides along hole 190 but cannot be removed from the bracket 182 due to the E-clips 188 on either side of the hole 190. The pin 184 is biased so as to insert into a jam access latch hole 144 in the side walls 140 of lower portion 121 to maintain the upper portion 201 in the closed position. If the user pulls pins 184 inward, then the pins 184 will retract from the holes 190 and allow the upper portion 201 to pivot about pivot point 161 so that a jam can be cleared.

A drive assembly 300 provides input power for rotating the drive shaft 104. The drive assembly 300 includes: a conveyor pulley 302, a folder pulley 304, a tension pulley 306 and a notched drive belt 308. The conveyor pulley 302 is fixably mounted to the drive shaft 104. The folder pulley 304 is fixably mounted to a shaft 305 coming off of the third pair of folding rollers 26. The tension pulley 306 is rotatively mounted to an elongate bracket 310 which is pivotally mounted at one end to the frame 102 while the other end of the bracket 310 travels in a slot 316 in the frame 102. The bracket 310 includes a fastener 314 for locking the bracket 310 in place along the slot 316. Thus, the tension pulley 306 can be adjusted to insure that adequate tension is provided on the notched drive belt 308. Accordingly, as the third pair of folding rollers 26 rotates, the folder pulley 304 also rotates and provides the input drive necessary to cause the drive shaft 104 to rotate.

Referring to FIG. 3, the carriage assembly 120 is shown in operative position A with the pins 154 in first repositioning holes 112. In this position, the buckle chute 28 is removed from the folder module 20. Additionally, the upper portion 201 of the carriage assembly 120 is shown in the closed position with the idler rollers 210, 210*a* and 220 biased toward the corresponding drive rollers 132 and 132*a*. Thus, the idler rollers 210, 210*a* and 220 are in working relationship with the endless belt 138. In position A, the carriage assembly 120 is positioned to accept a sheet 25 as it exits from the first pair of folding rollers 22. Thus, the sheet 25 bypasses all of the buckle chutes 28, 30, 32 and 34. This is referred to as "straight through" operation where the sheet 25 is not being folded.

Referring to FIG. 7B, the carriage assembly 120 is shown in operative position B with the pins 154 in second repositioning holes 114. In this position, the buckle chute 32 is removed from the folder module 20. Additionally, the upper portion 201 of the carriage assembly 120 is shown in the closed position with the idler rollers 210, 210*a* and 220 in working relationship with the endless belt 138. In position B, the carriage assembly 120 is shown ready to accept a sheet from the second pair of folding rollers 24. Thus, the sheet 25 may potentially encounter buckle chutes 28 and 30, but not buckle chute 32. However, either buckle chute 28 or buckle chute 30 may be replaced by a diverter (not shown) so that in this position the sheet 25 only encounters one buckle chute instead of two buckle chutes.

Referring to FIG. 7C, the carriage assembly 120 is shown in operative position C with the pins 154 in third repositioning holes 116. As in FIGS. 3 and 7B, the upper portion 201 is in the closed position with the idler rollers 210, 210*a* and 220 in working relationship with the endless belt 138. In position C, the conveyor module 100 is shown positioned to accept the sheet 25 from the third pair of folding rollers 26. In this position, the sheet 25 potentially encounters all buckle chutes 28, 30, 32 and 34. However, any number of the buckle chutes 28, 30, 32 and 34 may be replaced with a diverter (not shown) so that the sheet 25 encounters one, two, three or four buckle chutes depending upon the desired fold configuration.

Referring to FIG. 7A, the carriage assembly 120 is shown in operative position A with the pins 154 in first repositioning holes 112. However, in contrast to FIGS. 3, 7B and 7C, the upper portion 201 is shown in the open position with the idler rollers 210 and 220 spaced apart from the endless belt 138. In the open position, the user has access to the friction drive system for clearing a sheet 25 that has jammed. Although the open position of the upper portion 201 is only shown with respect to position A, it will be understood by those skilled in the art that the upper portion 201 can be in the closed or open position in each of the operative positions A, B and C.

Referring to FIGS. 3, 7B and 7C, it should now be appreciated that the distance between the first pair of folding rollers 22 and the carriage assembly 121 in position A is greater than the distance between the third pair of folding rollers 26 and the carriage assembly 121 in position C. Accordingly, the distance between the second pair of folding rollers 24 and the carriage assembly 121 in position B is greater than the distance between the third pair of folding rollers 26 and the carriage assembly 121 in position C but less than the distance between the first pair of folding rollers 22 and the carriage assembly 121 in position A. This arrangement is consistent with the variable and changing length of the sheet 25 as it passes through the folder module 20. The longest sheet 25 will be the one that has no folds and operates in position A in "straight through" mode. Conversely, the shortest sheet 25 is the one that passes through the most buckle chutes 28, 30, 32 and 34 and therefore has the most folds. This shortest sheet 25, will exit the third pair of folding rollers 26 when the carriage assembly 121 is in position C.

In most instances, the original length of the sheet 25 before entering the folder module 20 is sufficient to ensure that the sheet 25 will bridge the gap or distance between the folding rollers 22, 24 and 26 and the carriage assembly 120 in operative positions A, B and C, respectively. However, to accommodate those situations where the operator is using sheets 25 with a very small original length, a first guide assembly 400 is provided to bridge the distance between the folding rollers 22, 24 and 26 and the endless belt 138. The first guide assembly 400 exists in three different versions corresponding to the different operating positions of the carriage assembly 120. The first guide assembly version A 410 corresponds to position A of the carriage assembly 120. The first guide assembly version B 430 corresponds to position B of the carriage assembly 120. Similarly, the first guide assembly version C 450 corresponds to position C of the carriage assembly 120.

Referring to FIGS. 3, 4, 5 and 7A, the carriage assembly 120 is shown in position A and the first guide assembly version A 410 is also shown. Version A 410 includes a generally U-shaped bracket 412 having a guide portion 414 and side walls 413. The side walls 413 are detachably mounted to the folder module 20. The guide portion 414 is disposed in the path of travel so as to cover the second pair of folding rollers 24 and guide the sheet 25 from the first pair of folding rollers 22 to the endless belt 138. Arms 415 are pivotally mounted at one end to the side walls 413. Fixably mounted to the other end of the arms 415 is a shaft 416. Rotatively mounted to the shaft 416 are drive rollers 418 having grooves 420. O-rings 422 extend between the drive rollers 418 and the idler rollers 210*a* fitting inside of grooves 420 and 212*a*, respectively. Thus, it is now understood that the drive rollers 418 receive their input from the idler rollers 210*a*. Additionally, the side walls 413 have stops 424 which are located so as to prevent excessive downward rotation of the arms 415. In this way, the O-rings 422 are prevented from contacting the guide portion 414 of the bracket 412. However, the arms 415 are free to rotate away from the guide portion 414 to accommodate different thicknesses of sheet 25. Thus, version A compensates for different thicknesses of sheets 25 that are fed from the first pair of folding rollers 22, and also, prevents excessive wear of the O-rings 422 due to contact with the guide portion 414.

Referring to FIG. 7B, the carriage assembly 120 is shown in position B and the first guide assembly version B 430 is also shown. The first guide assembly version B 430 is used when the carriage assembly 120 is in position B. Generally, version B 430 is analogous to version A 410. However, the exact shapes and configurations of version B 430 will change slightly due to the different distance between the second pair of folding rollers 22 and the endless belt 138 when the carriage assembly 120 is in position B. Version A 430 includes a generally U-shaped bracket 432 having a guide portion 434 and side walls 433. The side walls 433 are detachably mounted to the folder module 20. The guide portion 434 is disposed in the path of travel so as to cover the third pair of folding rollers 26 and guide the sheet 25 from the second pair of folding rollers 24 to the endless belt 138. Arms 435 are pivotally mounted at one end to the side walls 433. Fixably mounted to the other end of the arms 435 is a shaft 426. Rotatively mounted to the shaft 436 are drive rollers 438 having grooves 440. O-rings 442 extend between the drive rollers 438 and the idler rollers 210*a* fitting inside of grooves 440 and 212*a*, respectively. Thus, it is now understood that the drive rollers 438 receive their input from the idler rollers 210*a*. Additionally, the side walls 433 have stops 444 which are located so as to prevent excessive downward rotation of the arms 435. In this way, the O-rings 442 are prevented from contacting the guide portion 434 of the bracket 432. However, the arms 435 are free to rotate away from the guide portion 434 to accommodate different thicknesses of sheet 25. Thus, version B compensates for different thicknesses of sheets 25 that are fed from the second pair of folding rollers 24, and also, prevents excessive wear of the O-rings 442 due to contact with the guide portion 434.

Referring to FIGS. 3, 4, 5, 7A, 7B and 7C, the first guide assembly version C 450 is used when the carriage assembly 120 is in operative position C. In operative position C, the distance between the third pair of folding rollers 26 and the endless belt 138 is sufficiently small such that the active driven arrangements in version A 410 and version B 430 are unnecessary. Therefore, version C only requires a guide 452. The guide 452 is mounted on a bracket 454 that is fixably mounted to the folder module 20. Since first guide assembly version C does not cause any clearance problems with other components in either the folder module 20 or the conveyor module 100, it is permanently installed. In other words, version C is always present whether it is being used or not.

In similar fashion to the first guide assemblies 410, 430 and 450, a second guide assembly 600 is provided to assist the interface between the carriage assembly 120 and the input end of the downstream module 40. The second guide assembly 600 includes: a sleeve 602, a deflector 604, a first input roller 606 having groove 607, a second input roller 608 having groove 609, drive rollers 610, a first bracket 614, a second bracket 616, a shaft 622 and an O-ring 624. The second bracket 616 having a guide portion 618 and suitable openings 620. The first bracket 614 is fixably mounted to the frame 102 while the second bracket 616 is fixably mounted to the first bracket 614. The shaft 622 is rotatively mounted to the second bracket 616 and the drive rollers 610 are fixably mounted to each end of the shaft 622. The second input roller 608 is also fixably mounted to the shaft 622 between the drive rollers 610 and fitting inside the guide opening 620. The first input roller 606 is fixably mounted to the drive shaft 104. The O-ring 624 extends between the first input roller 606 and the second input roller 608 fitting inside of grooves 607 and 609, respectively. Thus, rotation of drive shaft 104 also causes rotation of shaft 622. The sleeve 602 has an axial through hole (not shown) and positioning holes 632. The second upper shaft 208 passes through the axial hole in the sleeve 602. Thus, the sleeve 602 is free to rotate about the shaft 208. The deflector 604 is fixably mounted to the sleeve 602 by thumb screws 634 which pass through the sleeve 602 to the shaft 208. Thus, the thumb screws 634 also lock the deflector 604 and sleeve 602 in place on the shaft 208. Accordingly, the thumb screws 634 are used to adjustably position the deflector 604 and sleeve 602 radially about the shaft 208.

Those skilled in the art will now recognize that the folder module 20 supplies all the input necessary to drive the conveyor module 100, including: carriage assembly 120, first guide assembly version A 410, first guide assembly version B 430 and second guide assembly 600. The drive assembly 300 operatively couples the folder rollers drive system (not shown) with the drive shaft 104 which in turn supplies the input necessary for the friction drive system of the carriage assembly 120. The first guide assembly version A 410 and first guide assembly version B 430 are driven off of idler rollers 210*a* while the second guide assembly 600 is driven off of input roller 606 which is also mounted to drive shaft 104.

Referring to FIGS. 3, 7B and 7C, the user must first determine how the sheets 25 are to be processed before the folder module 20 and the conveyor module 100 can be set up. The desired fold configuration of the sheet 25, determines the number of buckle chutes 28, 30, 32 and 34 as well as the number of folding rollers 22, 24 and 26 that are needed. Therefore, the user first sets up the folder module 20 by installing and/or removing buckle chutes 28, 30, 32 and 34 as necessary to achieve the desired fold configuration. Thus, the user now knows which pair of folding rollers 22, 24 and 26 the sheet 25 will exit from. Next, the user will reposition the carriage assembly 120 to accept the sheet 25 as it exits the folder module 20. This is achieved by pulling inward toward the center line CL of the sheet 25 on reposition latch pins 154. Pulling on the pins 154 causes them to retract from the corresponding positioning holes 112, 114 and 116. With the pins 154 in the retracted position, the carriage assembly 120 is now free to pivot about drive shaft 104. Thus, the carriage assembly 120 can now be moved into position A, B or C depending on where the sheet 25 will exit the folder module 20. Once the carriage assembly 120 is rotated to the desired position, the user releases the latch pins 154 and the springs 156 force the pins 154 into the corresponding positioning holes 112, 114 or 116 and locking the carriage assembly 120 in place. If the carriage assembly 120 is in position A, then the first guide assembly version A is installed. If the carriage assembly 120 is in position B, then the first guide assembly version B is installed. If the carriage assembly 120 is in position C, then no further action is required by the user since first guide assembly version C is permanently installed. Next, the user will adjust the second guide assembly 600 that is adjacent the input end of the downstream module 40. Depending upon whether the carriage assembly 120 is in position A, B, or C, the deflector 604 may need to assume a different radial position along shaft 208. Therefore, the user may loosen the thumb screws 634 and rotate the deflector 604 and sleeve 602 about the shaft 208 until the desired position is reached. Tightening the thumb screws 634 locks the deflector 604 and sleeve 602 in the desired position. The folder module 20 and the conveyor module 100 are now ready to process sheets 25.

The following description is provided to detail how the sheet 25 flows through the folder module 20 and the conveyor module 100. The description is provided with respect to the carriage assembly 120 being in position A. However, this description is directly analogous to the carriage assembly 120 being in position B or C. The sheet 25 enters the input end of folder module 20 and exits the first pair of folding rollers 22. With the first buckle chute 28 removed and the first guide assembly version A 410 installed, the sheet 25 bypasses the second pair of folding rollers 24 and the third pair of folding rollers 26. From this it follows that the sheet 25 will also not encounter the second buckle chute 30, third buckle chute 32 and fourth buckle chute 34. The leading edge of sheet 25 contacts guide 414 and is directed away from the second pair of folding rollers 24. As the first pair of folding rollers 22 continues to the sheet 25, the O-ring 422 comes in contact with the sheet 25 and continues to feed it along the guide 414. Thus, the leading edge of the sheet 25 is fed into the nip between endless belt 138 and the first idler roller 210*a*. The idler rollers 210, 210*a* and 220 provide the normal force to press the sheet 25 against the endless belt 138. The endless belt 138 thus conveys the sheet 25 along the entire length of the carriage assembly 120. As the sheet 25 is fed from endless belt 138, the second guide assembly 600 ensures that the sheet 25 is properly fed into the input end of the downstream module 40. The deflector 604 directs the leading edge of the sheet 25 into contact with the O-ring 624. Next, the O-ring 624 feeds the sheet 25 from the conveyor module 100 and into the downstream module 40. Thus, the sheet 25 has been fully processed by the folder module 20 and the conveyor module 100.

In the event that the sheet 25 is not handled properly, and a jam occurs in the conveyor module 100, the jam access latch assembly 180 provides access to the conveyor module 100 so that the user may clear the sheet 25 from the conveyor module 100. This is achieved by pulling inward toward the centerline CL of the sheet 25 on the pins 184 which retract the pins 184 from the holes 144 in the side walls 140. The upper portion 201 is now free to pivot about the holes 190. Thus, the upper portion 201 is rotated into an open position where the idler rollers 210 and 220 are now spaced apart from the endless belt 138. In this open position, the user can retrieve the jammed sheet 25. It should now be appreciated by those skilled in the art that the jam access as described above is available regardless of whether the carriage assembly is in position A, B, or C. It is important to note that the upper portion 201 pivots about pivot point 161 which is in axial alignment with idler rollers 210*a* so as not to disturb the first guide assembly version A 410 in operative position A or, in the alternative, the first guide assembly version B 430 in operative position B. Thus, to clear a jam no disassembly of version A 410 or version B 430 is necessary. Additionally, the sub-assembly that mounts the idler rollers 210, 210*a* and 220 to their respective shafts 206 and 208 includes a stop (not shown) for limiting the rotation of the bracket 230 when the idler rollers 210, 210*a* and 220 lose contact with the endless belt 138.

Many features of the preferred embodiment represent design choices selected to best exploit the inventive concept for as implemented in an inserter at the folder module output end. However, the present invention may have application to solve similar related problems. Moreover, additional advantages and modifications will readily occur to those skilled in the art. Therefore, the invention in its broader aspects is not limited to the specific details of the preferred embodiment. Accordingly, various modifications may be made without departing from the spirit of the general inventive concept as defined by the appended claims and their equivalents.

What is claimed is:

1. Apparatus for conveying a sheet in a path of travel from one of a plurality of positions from an output end of an upstream module to an input end of a downstream module, said conveying apparatus comprising:

a frame; and a carriage having an input end adjacent said upstream module output end and an output end adjacent said downstream module input end, said carriage output end pivotally mounted to said frame so that said carriage input end is rotatable to at least a selected one of said plurality of output positions of said upstream module, said carriage including conveyor means for feeding said sheet from said upstream module output end to said downstream module input end, said carriage further including a lower portion and an upper portion;

said lower portion including a deck;

said conveyor means comprising a plurality of drive rollers rotatively mounted to said lower portion so that a portion of said drive rollers extends above said deck, an endless belt engaging said drive rollers and drive means for rotating said drive rollers; and said upper portion including a chassis pivotably mounted to said lower portion to pivot between an open position and a closed position and a plurality of idler rollers rotatively mounted to said chassis so that in said closed position said idler rollers are operatively connected to said endless belt.

2. The conveyor apparatus of claim 1, wherein said lower portion includes first latch means for detachably locking said lower portion to said frame so that said carriage input end is locked adjacent to said selected one of said plurality of output positions of said upstream module; and said upper portion includes second latch means for detachably locking said upper portion to said lower portion.

3. The conveyor apparatus of claim 2, further comprising first guide means for directing said sheet away from said selected one of said plurality of output positions of said upstream module and toward said endless belt.

4. The conveyer apparatus of claim 3, further comprising second guide means for directing said sheet into said downstream module input end as said sheet exits from said endless belt.

5. A conveyor module for feeding a sheet in a path of travel through an inserter including a folder module having an output end and a downstream module having an input end, said folder module having a plurality of pairs of folding rollers and a plurality of output positions corresponding to said plurality of pairs of folding rollers, said conveyor module comprising:

a frame; and a carriage having an input end adjacent said folder module output end and an output end adjacent said downstream module input end, said carriage output end pivotally mounted to said frame so that said carriage input end is rotatable to at least a selected one of said plurality of output positions of said folder module, said carriage including conveyor means for feeding said sheet from said folder module output end to said downstream module input end;

said carriage further including a lower portion an upper portion, said lower portion including a deck with laterally opposed side walls; and said conveyor means comprising a plurality of drive rollers rotatively mounted to said lower portion so that a portion of said rollers extends above said deck, an endless belt engaging said drive rollers and drive means for rotating said drive rollers; and wherein said upper portion includes a chassis pivotably mounted to said lower portion to pivot between an open position and a closed position and a plurality of idler rollers rotatively mounted to said chassis so that in said closed position said idler rollers are operatively connected to said endless belt.

6. The conveyor module of claim 5, wherein said lower portion includes first latch means for detachably locking said lower portion to said frame so that said carriage input end is locked adjacent to said selected one of said plurality of output positions of said upstream module; and said upper portion includes second latch means for detachably locking said upper portion to said lower portion.

7. The conveyor apparatus of claim 6, further comprising first guide means for directing said sheet away from said selected one of said plurality of output positions of said folder module and toward said endless belt.

8. The conveyor apparatus of claim 7, further comprising second guide means for directing said sheet into said downstream module input end as said sheet exits from said endless belt.

9. In a sheet handling apparatus including a folder module having an input end and an output end, a plurality of pairs of folding rollers and a plurality of buckle chutes; said pairs of folding rollers offset both laterally and vertically from one another, a conveyor module for feeding a sheet away from said folder module in a path of travel to a downstream module having an input end, said folder module input end in substantially horizontal alignment with said downstream module input end, said conveyor module comprising:

a frame having a plurality of positioning holes in operative alignment with said pairs of folding rollers, respectively;

a drive shaft rotatively mounted to said frame to extend transverse to said path of travel and located adjacent to said downstream module input end; said positioning holes arranged in a radial pattern about said drive shaft;

drive means for rotating said drive shaft;

a carriage including a lower portion and an upper portion each extending between said output end of said folder module and said downstream module input end, said lower portion including:

an elongate deck having a plurality of openings, a plurality of drive rollers disposed between said folder module output end and said downstream module input end, one of said drive rollers fixably mounted to said drive shaft and remaining drive rollers rotatively mounted to said lower portion, a portion of said drive rollers extending above said deck through said openings, laterally opposed side walls extending vertically from said deck and substantially parallel to said path of travel on either side of said sheet, a plurality of sleeves having an inner hole, said sleeves positioned axially along said drive shaft, said side walls fixably mounted to said sleeves, respectively, so that said carriage pivots about said drive shaft independent of rotation of said drive shaft, first latch means for detachably mounting to said positioning holes and locking said carriage adjacent a predetermined pair of said folding rollers, and an endless belt engaging said plurality of drive rollers, said upper portion including:

a chassis pivotably mounted to said side walls of said lower portion, a plurality of idler rollers including a first idler roller adjacent said output end of said folder module, said plurality of idler rollers rotatively mounted to said chassis so that in a closed position said idler rollers are in working relationship with said endless belt and in an open position some of said idler rollers are spaced apart from said endless belt, said chassis pivoting about a point in axial alignment with said first idler roller, means for biasing said idler rollers in said closed position toward said opposing drive rollers to press said sheet against said endless belt, and second latch means for detachably mounting to said side walls of said lower portion and locking said upper portion in said closed position;

a first guide assembly including a guide detachably mounted to said frame and positioned adjacent said folder module output end at a predetermined pair of said folding rollers to guide said sheet away from said folding rollers and first guide drive means for feeding said sheet to said endless belt;

said endless belt feeding said sheet in said path of travel toward said downstream module input end; and a second guide assembly including a guide detachably mounted to said upper portion and positioned adjacent said downstream module input end to guide said sheet as it is fed from said endless belt toward said downstream module input end and second guide drive means for feeding said sheet into said downstream module input end.

* * * * *